US006416148B1

(12) United States Patent
Du et al.

(10) Patent No.: US 6,416,148 B1
(45) Date of Patent: Jul. 9, 2002

(54) METHOD AND SYSTEM FOR IMPROVING THE PRINT QUALITY OF A PRINTER

(75) Inventors: Ben-Chuan Du, Hsin-Tien; Yung-Yi Li, Yung-Kang, both of (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/754,221

(22) Filed: Jan. 5, 2001

(51) Int. Cl.[7] ..... B41J 29/38

(52) U.S. Cl. ..... 347/9; 347/37; 400/279; 400/283

(58) Field of Search ..... 347/5, 9, 10, 19, 347/37, 39, 211; 400/279, 283

(56) References Cited

U.S. PATENT DOCUMENTS 3,942,619 A * 3/1976 Nordstrom et al. ..... 400/322
4,328,504 A * 5/1982 Weber et al. ..... 347/19
4,345,263 A * 8/1982 Tazaki et al. ..... 347/14
4,524,364 A * 6/1985 Bain et al. ..... 347/39
6,013,998 A * 1/2000 Spurr et al. ..... 318/685
6,219,153 B1 * 4/2001 Kawanabe et al. ..... 358/1.16

* cited by examiner

*Primary Examiner*—John Barlow
*Assistant Examiner*—Blaise Mouttet
(74) *Attorney, Agent, or Firm*—Winston Hsu

(57) ABSTRACT

A printer has a print head for forming a pixel, and a driving system for moving the print head from a first location to a second location. The print head forms the pixel according to a firing signal. The movement of the print head is controlled by a control signal sent to the driving system. The method involves building a list of desired pixel locations, building a calibrated list of firing signal offsets, sending the control signal to trigger movement of the print head, and sending a firing signal to the print head to form a pixel at a predetermined location. The firing signal offsets correspond to the desired pixel locations, and are adjusted to compensate for the driving system. The timing of the firing signal is determined by the timing of the control signal and by a firing signal offset in the calibrated list of firing signal offsets. The firing signal offset adjusts the firing time so that the predetermined location of the pixel is effectively on a corresponding desired pixel location.

15 Claims, 13 Drawing Sheets

METHOD AND SYSTEM FOR IMPROVING THE PRINT QUALITY OF A PRINTER

BACKGROUND OF THE INVENTION

1. Field of the Invention

The present invention relates to a system and a method for improving the print quality of a printer. Specifically, the present invention discloses a system and method for adjusting the timing interval between a print head stepping signal and a print head firing signal so that pixels are formed at desired locations.

2. Description of the Prior Art

The increasing sophistication of computer systems has lead to a corresponding increase in the graphical resolutions of these systems. Computer monitors are displaying more pixels with more color, and scanners are scanning documents at more pixels per inch than ever before. There is, therefore, an equal demand placed upon printers to offer extremely high-resolution printing. A direct consequence of this is that finer tolerances are placed upon the print head driving systems of these printers.

Please refer to FIG. 1. FIG. 1 is a perspective view of a prior art printer 10. The prior art printer 10 has a carrier 9 that is slidably disposed on a print track 7. The carrier 9 can move forward and backward, which is indicated by the arrow FB. The carrier 9 is used to hold a print cartridge 6, which is removably fixed in the carrier 9.

Please refer to FIG. 2, in conjunction with FIG. 1. FIG. 2 is a block diagram of the prior art printer 10. The cartridge 6 has a print head 20. The print head 20 does the actual printing, jetting ink onto a document. The print head 20 comprises a plurality of orifices 22 that are used to jet ink onto the document. Generally speaking, the orifices 22 are arranged in rows and/or columns and can jet ink of different colors. For the sake of simplicity, the following discussion will concentrate on only one of the orifices 22. It should be born in mind, however, that the methods and systems discussed are all equally valid and designed for the full plurality of orifices 22.

The prior art printer 10 further comprises a control circuit 30 and a driving system 40. The driving system 40 comprises a stepping motor 42 that is controlled by a stepping integrated circuit (IC) 44. The stepping IC 44 provides electrical signals 46 to control the stepping motor 42. The driving system 40 is mechanically connected to the print head 20 to move the print head 20 along the print track 7. This mechanical connection is indicated by arrow 40*d*. The control circuit 30 controls the general operations of the printer 10. In particular, it sends a control signal 30*c* to the driving system 40 to trigger a stepping function of the stepping motor 42, and sends a firing signal 30*f* to the print head 20 to make the orifice 22 jet ink. In this manner, the control circuit 30 can get the print head 20 to move to a particular location and form a pixel at a desired pixel location.

Please refer to FIG. 3 in conjunction with FIGS. 1 and 2. FIG. 3 is a simple schematic diagram of the stepping motor 42. Please note that the structure of the stepping motor 42 has been greatly simplified. The stepping motor 42 comprises a rotor 43, a stator 45, and two pairs of coils wound on the stator 45. By supplying current to alternating coils on the stator 45, the rotor 43 can be made to rotate through succeeding 90 degree steps. With the configuration shown in FIG. 3, each 90 degree rotation of the rotor 43 is called a full-step. Thus, to create a full-step, current is turned off for the present pair of coils on the stator 45 and is turned on for the succeeding coils on the stator 45. Under this shifted magnetic field, the rotor 43 will rotate to align with the corresponding energized coils on the stator 45. As noted above, it is the stepping IC 44 that generates signals 46 to control the stator current.

It should be clear that not only full-steps are possible for the stepping motor 42. It is also possible to perform a half-step. To perform a half-step, the stepping IC 44 generates signals to supply current equally to both pairs of adjacent stators 45. From a vertical or a horizontal position, the rotor 43 will rotate 45 degrees, balancing between the equal magnetic fields generated by the adjacent stators 45. Current is then turned off for the preceding pair of stators 45, and the rotor 43 will make another 45 degree rotation, completing a full-step. In this manner, accurate half-stepping of the rotor can be achieved. Furthermore, steps finer than half steps can be achieved by varying the ratio of the stator current between adjacent pairs of stators 45. Such steps, finer than a half step, are termed micro-steps. It is the job of the stepping IC 44 to provide these carefully calibrated stator currents to provide accurate micro-stepping of the rotor 43. The stepping IC 44 may generate signals 46 to advance the stepping motor 42 by one micro-step when receiving proper control signals 30*c* from the control circuit 30.

By providing micro-stepping, the overall resolution of the stepping motor 42 is greatly increased, which directly leads to a finer pitch when printing. This is illustrated in FIG. 4 and FIG. 5. FIG. 4 is a phase diagram of angular displacements for micro-stepping of the stepping motor 42. FIG. 5 illustrates locations of the print head 20 resulting from each micro-step of FIG. 4. In FIG. 4, the micro-step number is indicated by an encircled numeral. For the stepping motor as shown in FIG. 3, each full step has been broken into 16 micro-steps, with the intermediate steps running from 1 to 15. Ideally, the angular rotation of the rotor 43 from one micro-step to the next should be 90°/16, which equals 5.6250°. Depending on the gearing of the driving system 40*d*, each of these micro-steps should be translated into an equal displacement of the print head 20 along the print track 7, such as $1/1200$ of an inch for a 1200 dpi printer. These displacements are indicated in FIG. 5, with the resulting location of each micro-step on the print track 7 indicated by its encircled numeral.

In the prior art, the control circuit 30 comprises a timer 32. The timer 32 is used to generate regularly spaced control signals 30*c* that are sent to the driving system 40. The interval between control signals 30*c* is of a sufficient length of time to enable the rotor 43 to move to and settle into the next micro-step position. The control circuit 30 then sends out the firing signal 30*f*, and the firing signal 30*f* will logically "AND" with the image data to activate the orifice on the print head to jet the ink. In other words, the print head will jet the ink if both the firing signal 30*f* and the image data are "1", and will not jet the ink if either one of the firing signal 30*f* or the image data is "0". Thus, the same interval $\Delta t$ exists between successive firing signals 30*f* and successive control signals 30*c*, the two signals having only a constant time delay between them. The timing of the control and firing signals is indicated in FIG. 6. The result of these two signals 30*c* and 30*f*, in conjunction with the even micro-steps of the stepping motor 42, should result in pixels placed at evenly spaced intervals. That is, with each successive micro-step, a pixel should be formed on a desired pixel position 23 that corresponds to that micro-step, as indicated in FIG. 5.

The above is the ideal. The reality is that the stepping IC 44 is unable to evenly divide the angular distribution of the micro-steps between full-steps. This problem is illustrated in FIG. 7. FIG. 7 is a phase diagram of the actual angular displacements for the micro-stepping of the stepping motor 42. The stepping IC 44 uses some approximation technique (e.g. linear approximation) to map the arc of the full-step. This results in some of the micro-steps making too large of a rotation, and others making rotations that are too small. This irregularity in the angular distributions of the micro-steps results in a corresponding irregular distribution of the position of the print head 20 at each micro-step. Consequently, the actual printed pixel locations do not land on the desired pixel locations. This is illustrated in FIG. 8, which contrasts desired pixel locations with actual pixel locations, with 0.01 inches per full-step and 16 micro-steps per full-step.

SUMMARY OF THE INVENTION

It is therefore a primary objective of this invention to provide a method and system for forming pixels on desired pixel locations by adjusting the relative timing between the control signal and the firing signal.

The present invention, briefly summarized, discloses a method and corresponding system for improving the print quality of a printer. The printer has a print head for forming a pixel, and a driving system for moving the print head from a first location to a second location. The print head forms the pixel according to a firing signal. The movement of the print head is controlled by a control signal sent to the driving system. The method involves building a list of desired pixel locations, building a calibrated list of firing signal offsets, sending the control signal to trigger movement of the print head, and sending a firing signal to the print head to form a pixel at a predetermined location. The firing signal offsets correspond to the desired pixel locations, and are adjusted to compensate for the driving system. The timing of the firing signal is determined by the timing of the control signal and by a firing signal offset in the calibrated list of firing signal offsets. The firing signal offset adjusts the firing time so that the predetermined location of the pixel is effectively on a corresponding desired pixel location.

It is an advantage of the present invention that by carefully adjusting the time interval between the sending of the control signal and the sending of the firing signal, variations in the driving system of the print head are compensated. Specifically, variations in the angular movement of the micro-stepping of a stepping motor can be considered. Pixels are therefore formed on their respective desired locations.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
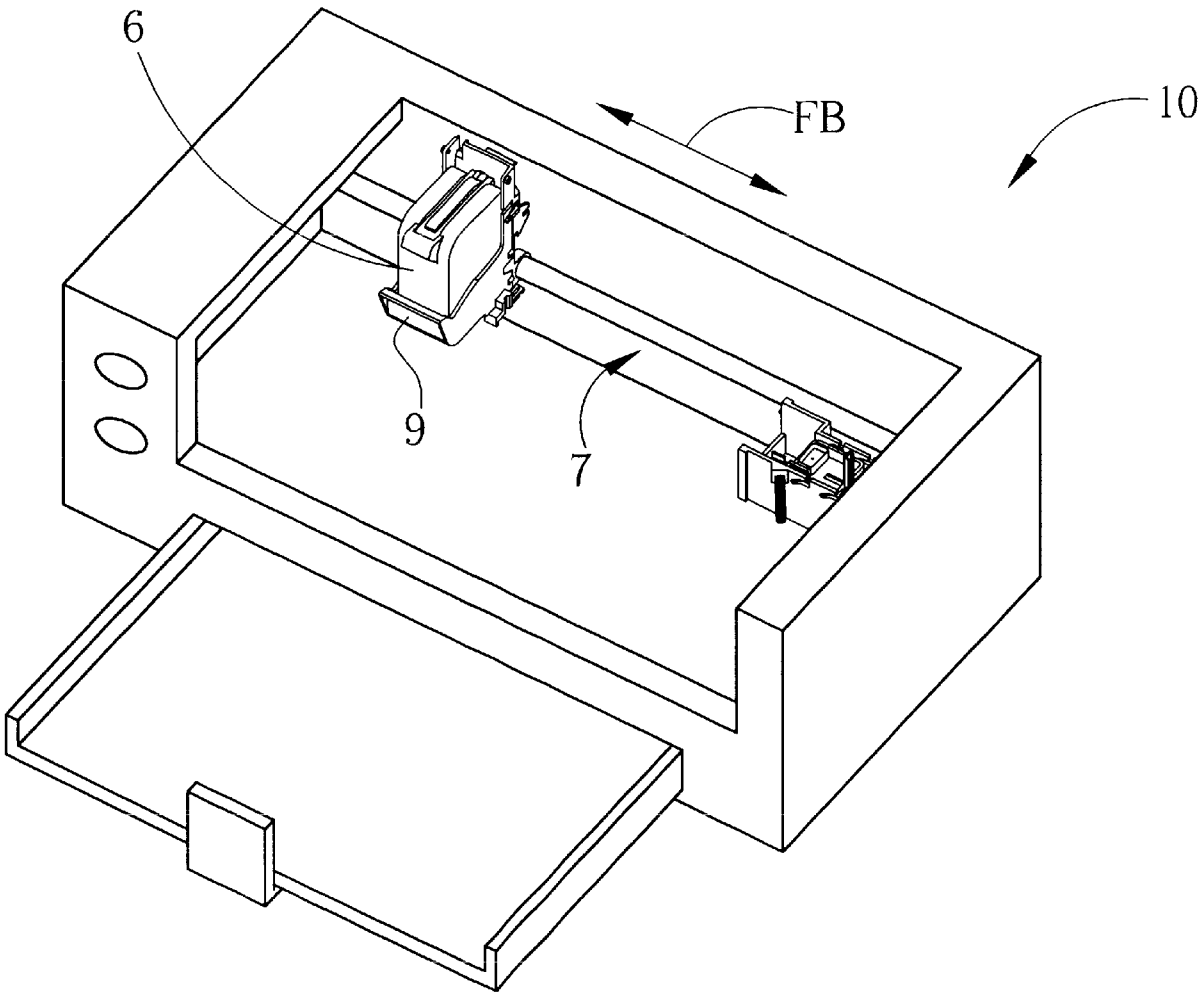
Fig. 1 Prior art
FIG. 1 is a perspective view of a prior art printer
Figure 2:
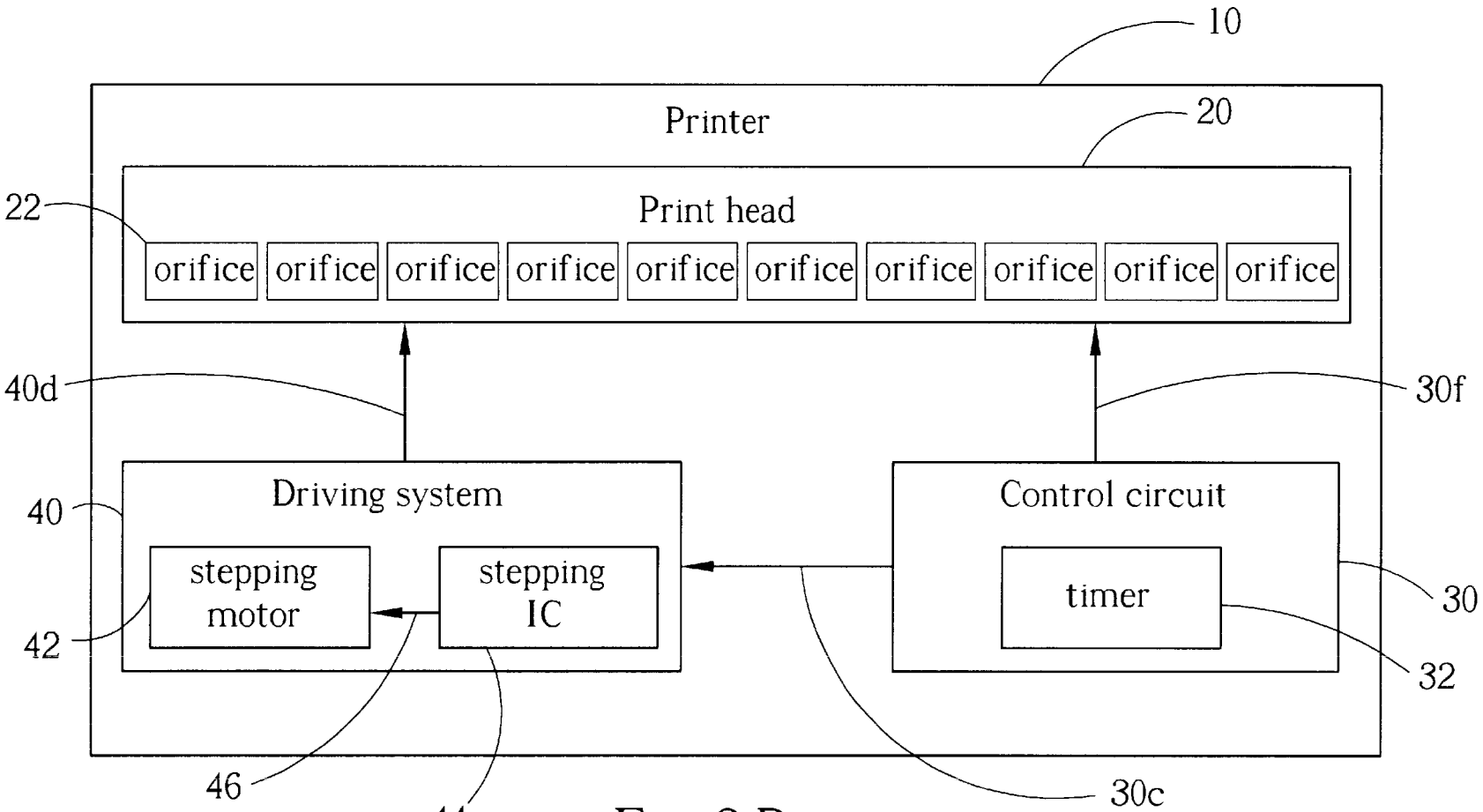
Fig. 2 Prior art
FIG. 2 is a block diagram of the prior art printer shown in FIG. 1.
Figure 3:
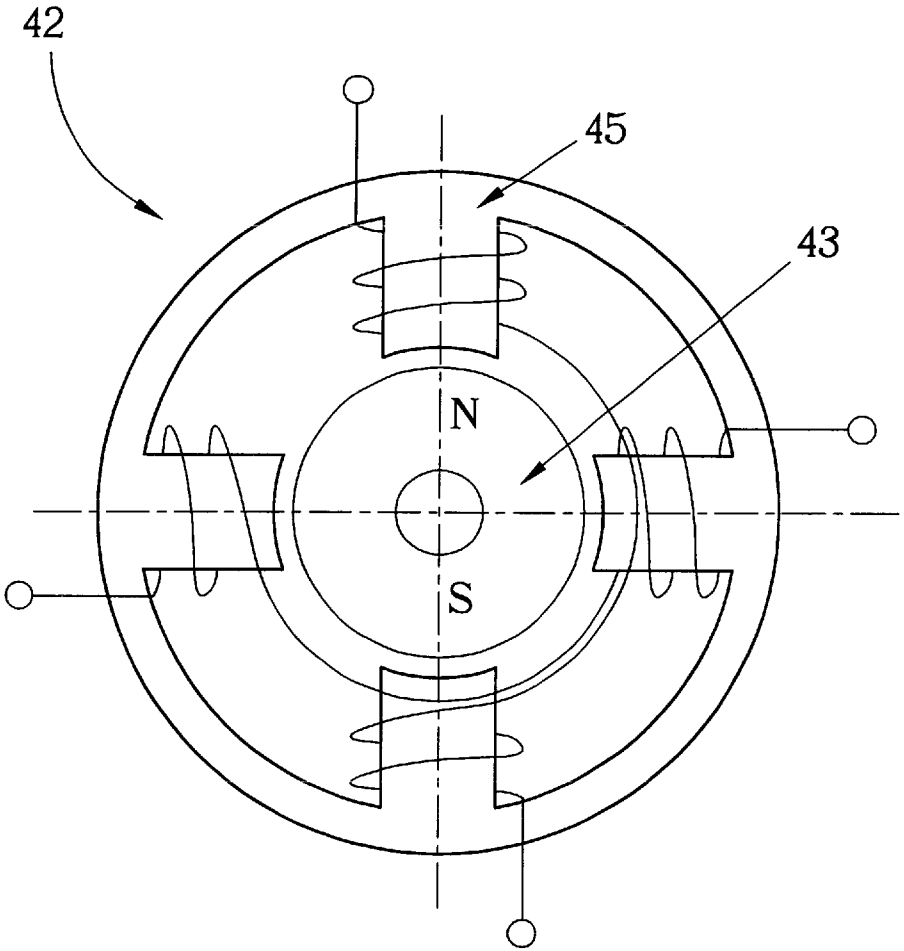
Fig. 3 Prior art
FIG. 3 is a simple schematic diagram of a stepping motor of the printer depicted in FIG. 1.
Figure 4:
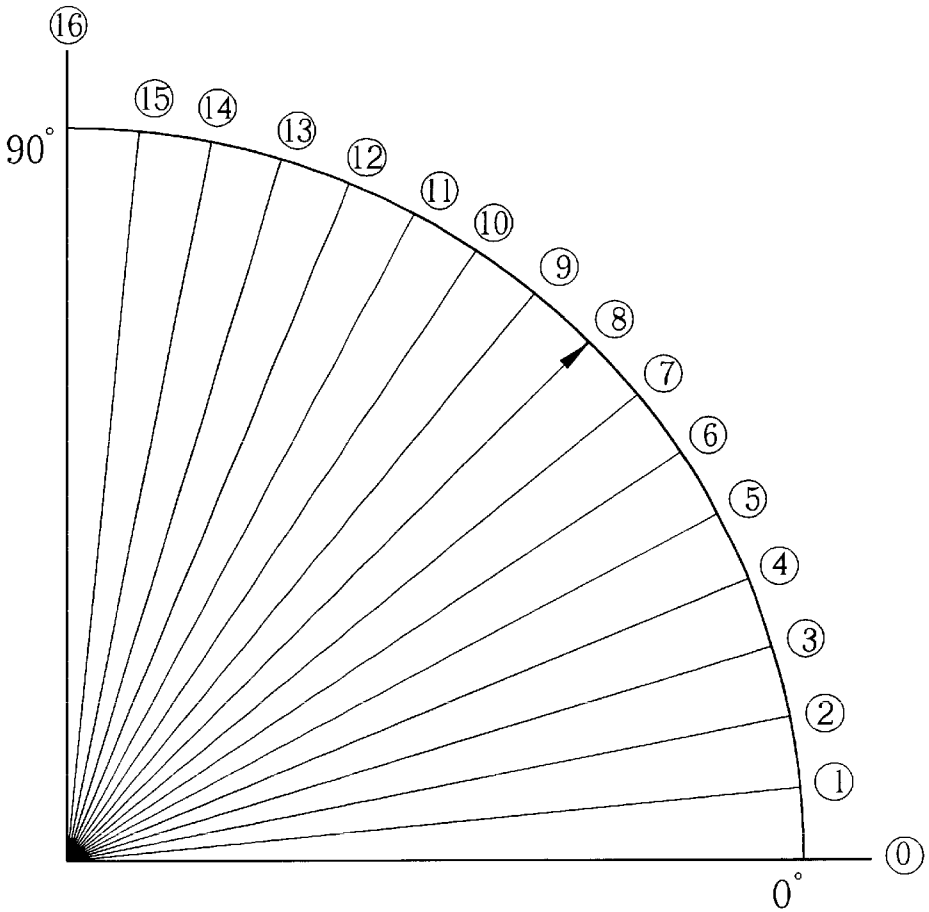
Fig. 4 Prior art
FIG. 4 is a phase diagram of ideal angular displacements for micro-stepping of the stepping motor of FIG. 3.
Figure 5:
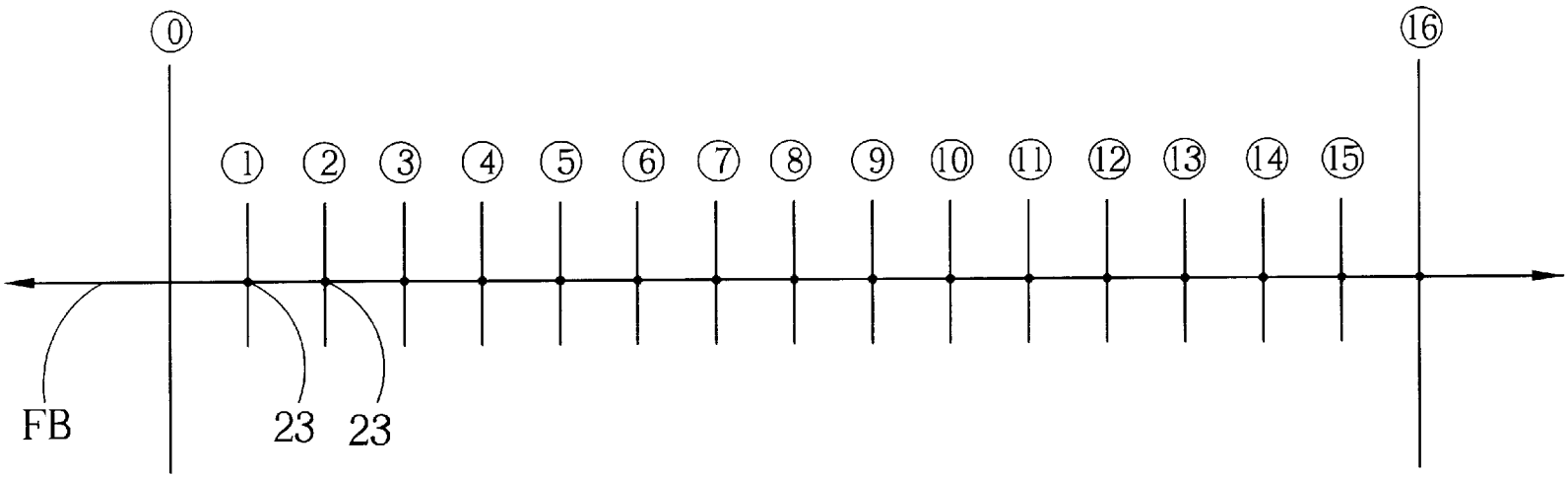
Fig. 5 Prior art
FIG. 5 illustrates locations of a print head resulting from each micro-step of FIG. 4.
Figure 6:
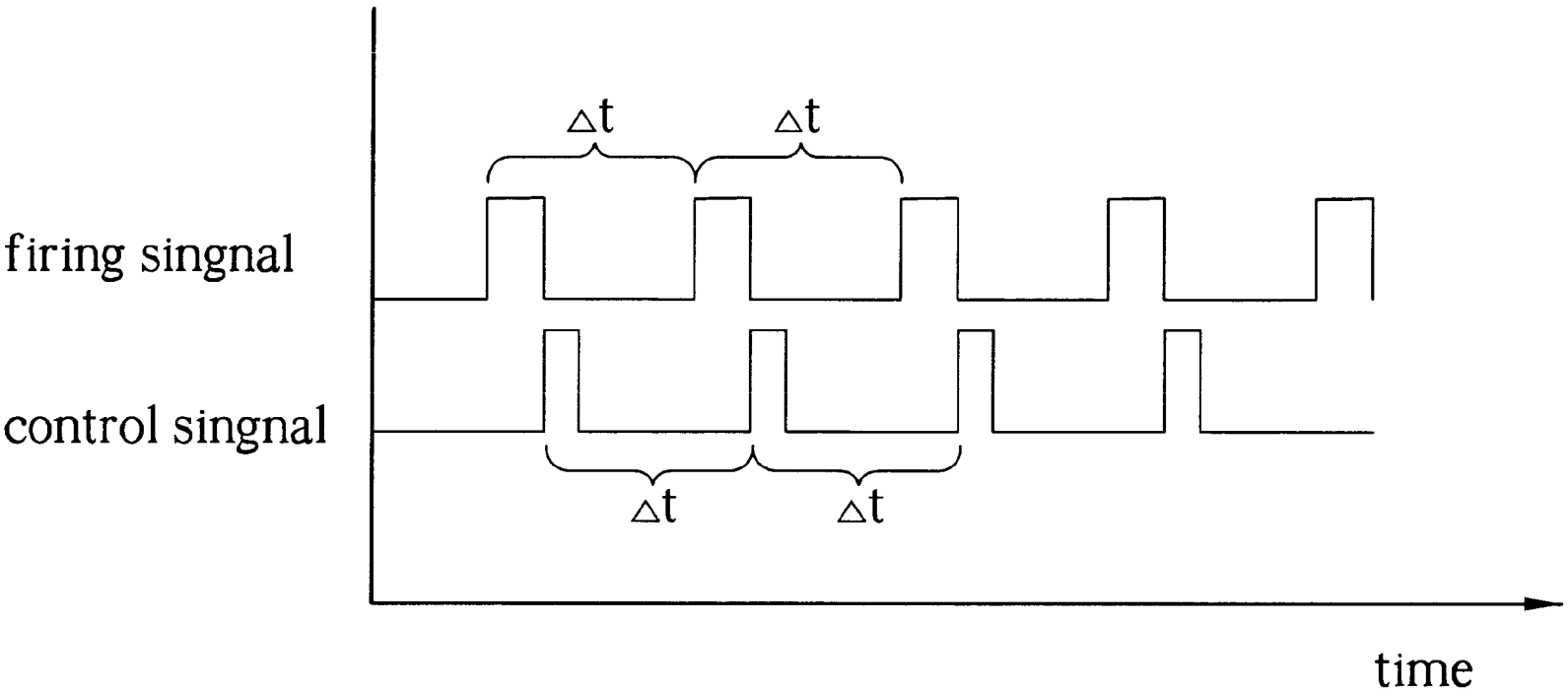
Fig. 6 Prior art
FIG. 6 is a timing diagram control and firing signals for the printer of FIG. 1.
Figure 7:
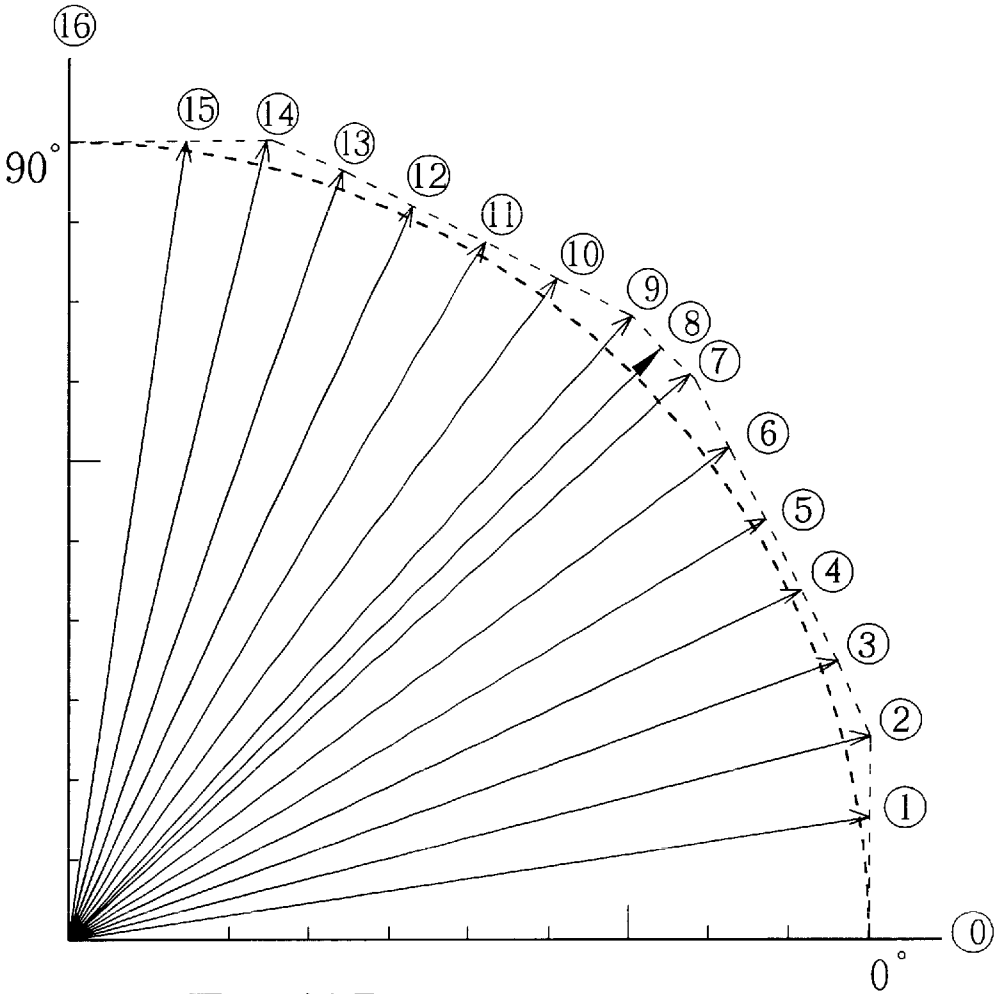
Fig. 7 Prior art
FIG. 7 is a phase diagram of actual angular displacements for micro-stepping of the stepping motor of FIG. 3.
Figure 8:
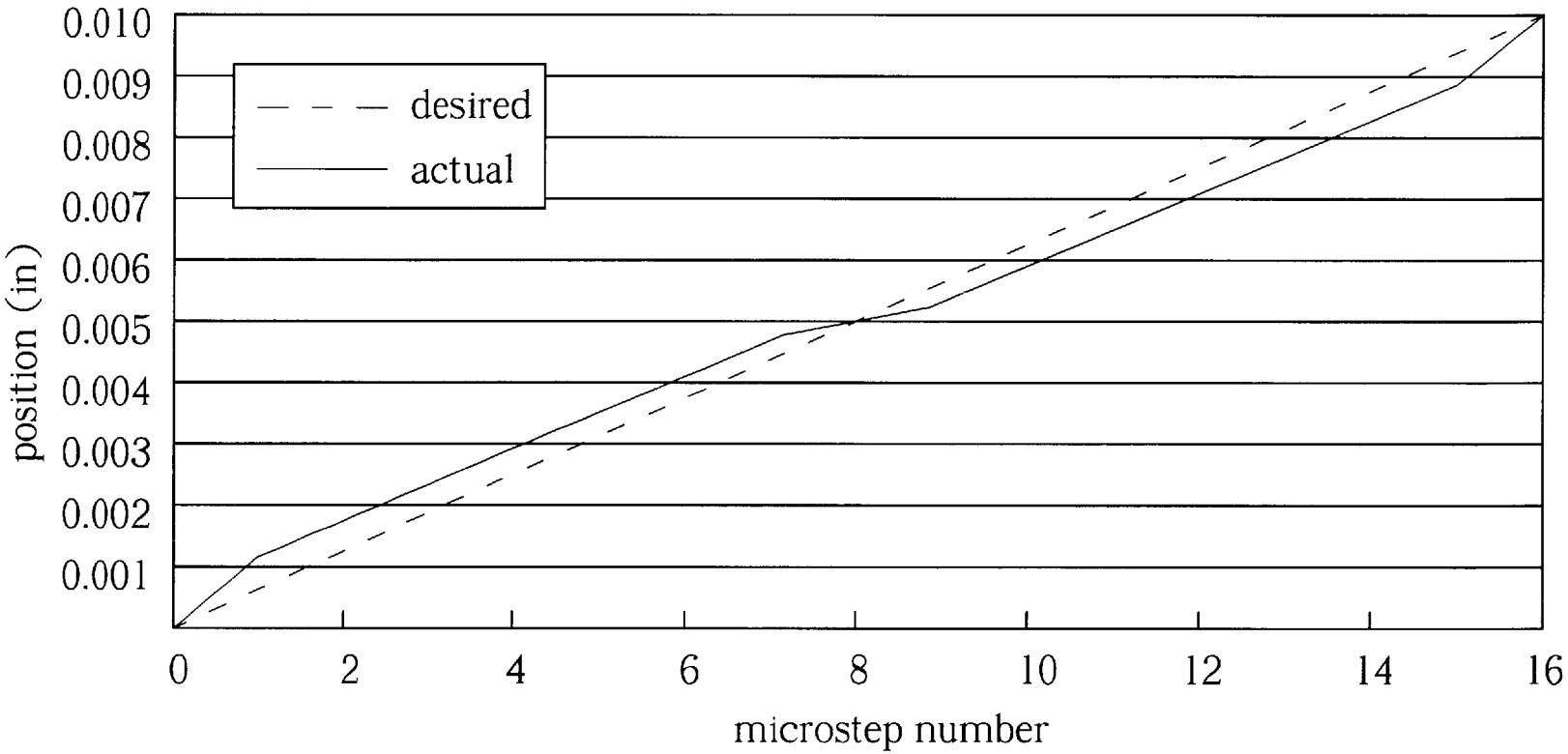
Fig. 8 Prior art
FIG. 8 is a graph of desired pixel locations and actual pixel locations for a prior art print head driving system.
Figure 9:
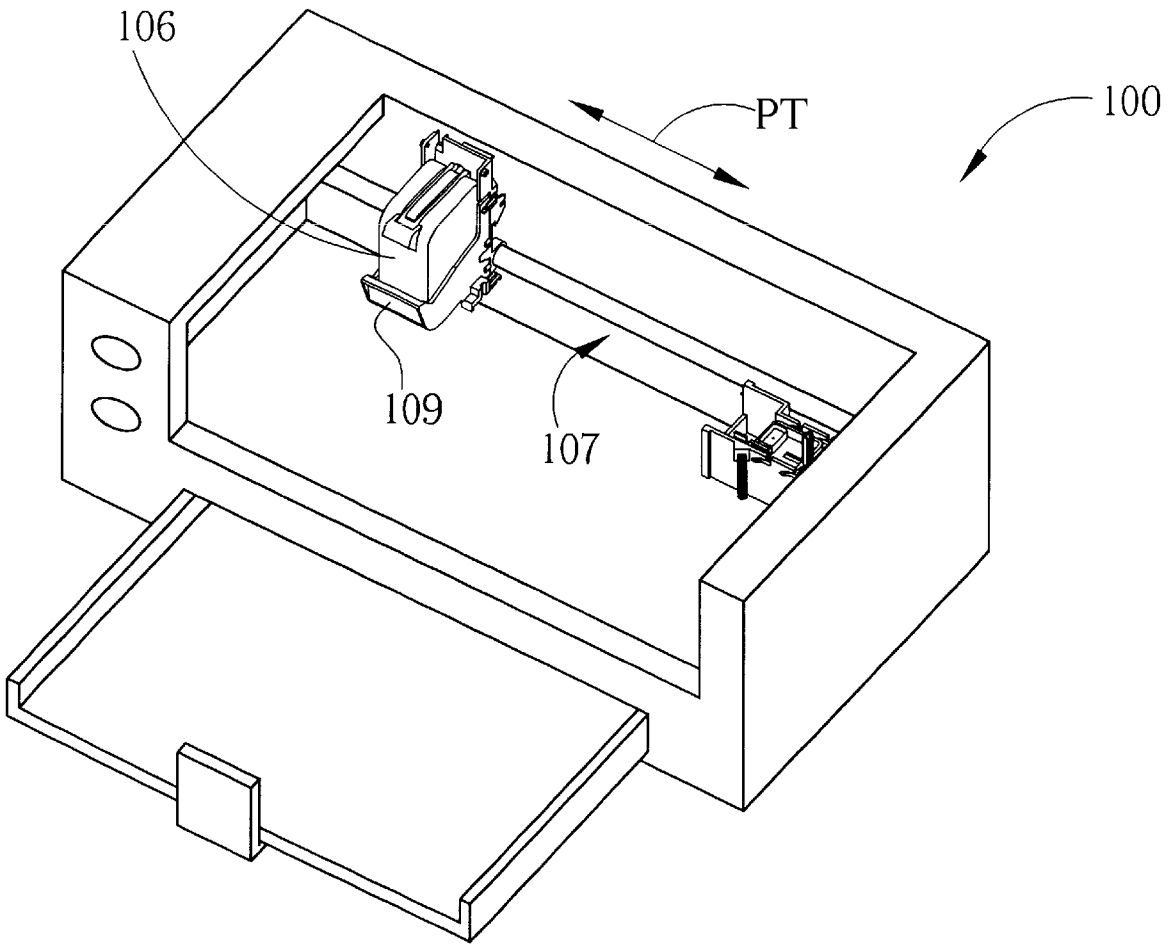
FIG. 9 is a perspective view of a present invention printer.
Figure 10:
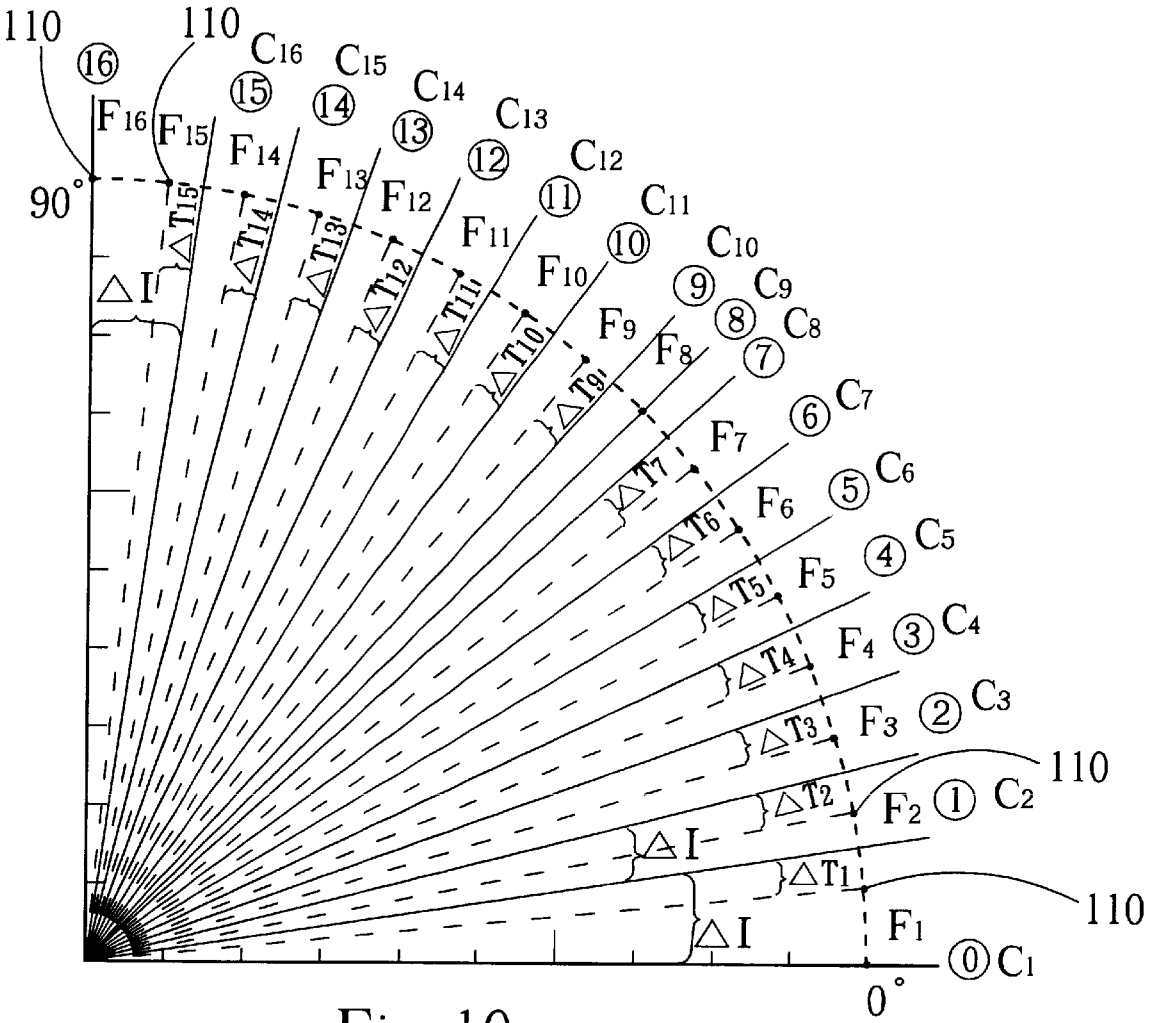
FIG. 10 is a phase diagram of angular displacements for the micro-stepping of a stepping motor that is used in the printer of FIG. 9.
Figure 11:
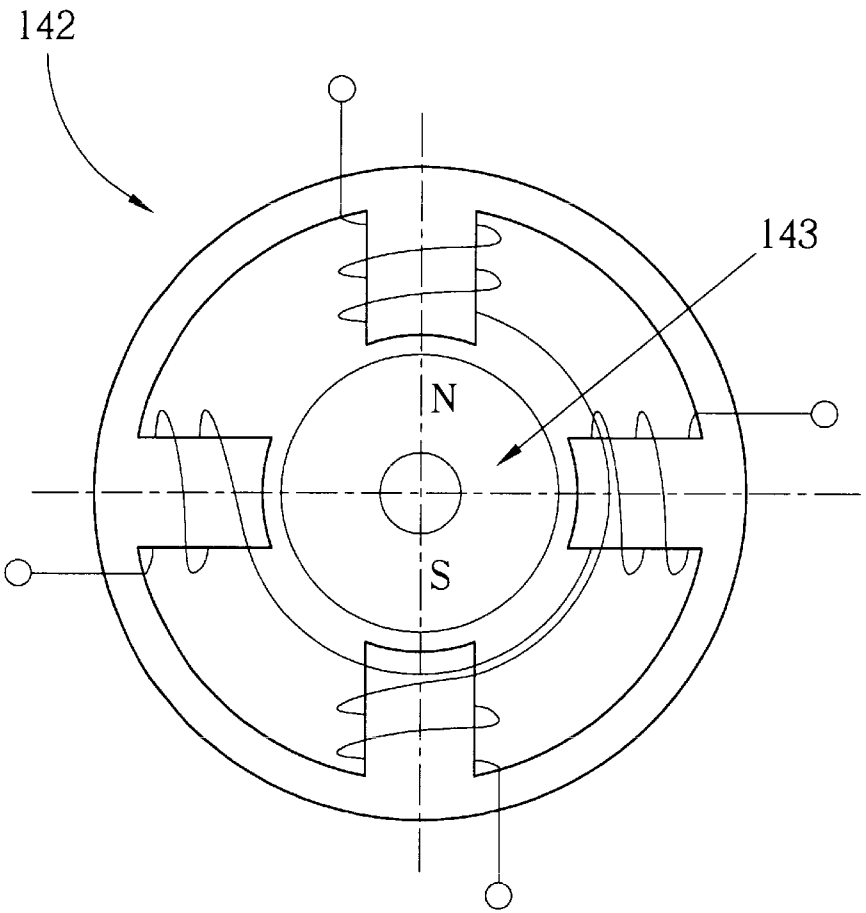
FIG. 11 is a simplified schematic diagram of a stepping motor for the present invention.
Figure 12:
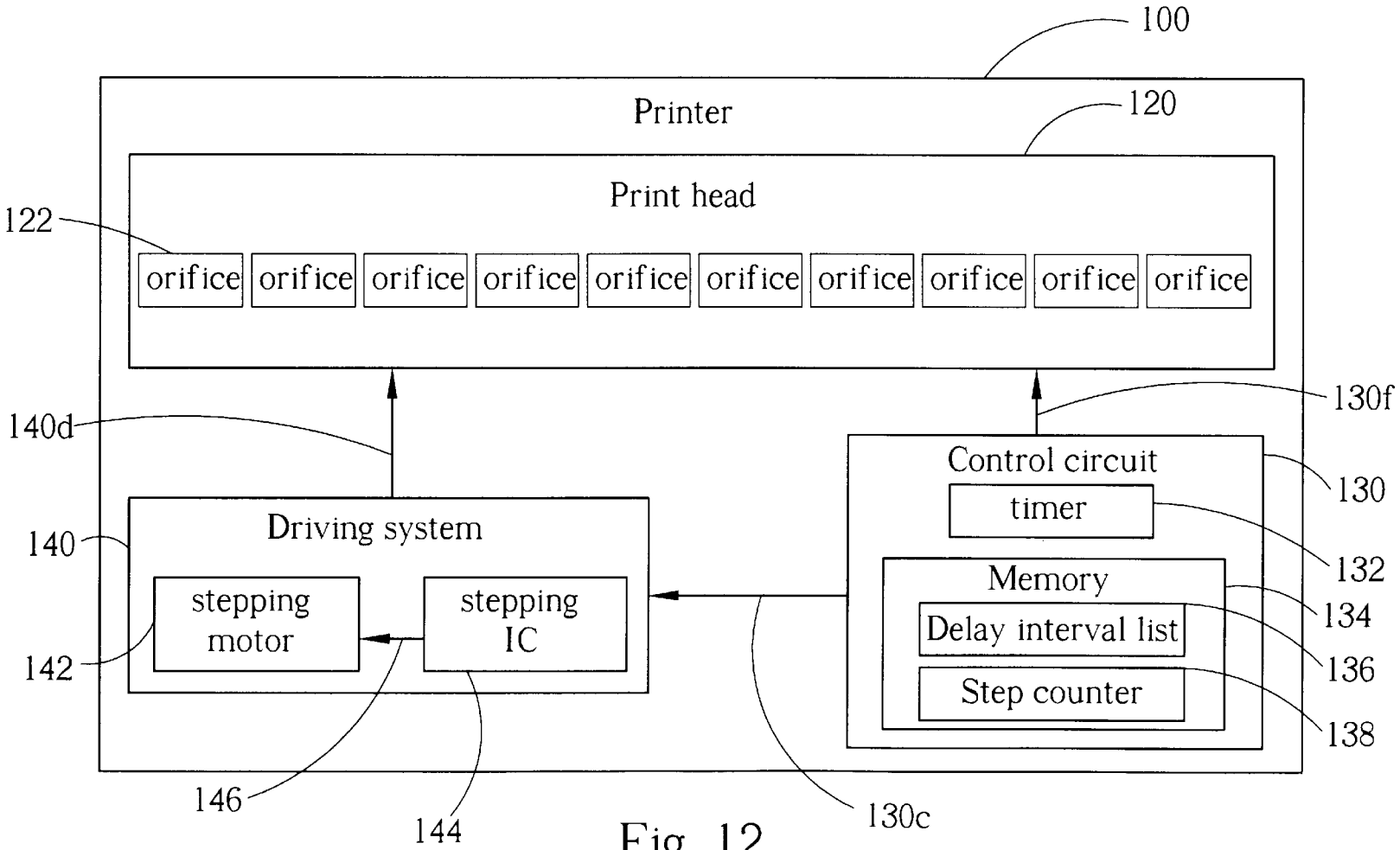
FIG. 12 is a block diagram of a printer according to the present invention.

Please refer to FIG. 9 to FIG. 12. FIG. 9 is a perspective view of a printer 100 of the present invention. FIG. 10 is a phase diagram of actual angular displacements for the micro-stepping of a stepping motor 142 that is used in the printer 100. FIG. 11 is a simplified schematic diagram of the stepping motor 142. FIG. 12 is a block diagram of the printer 100. As in the prior art printer 10, the present invention printer comprises a carriage 109 that moves a print cartridge 106 forward and backward along a print track 107. The direction of movement along the print track 107 is indicated by arrow PT. The cartridge 106 has a print head 120 that does the actual printing. A stepping motor 142 is used to drive the carriage 109, and hence the cartridge 106. The stepping motor 142 is micro-stepped to obtain a high angular resolution, and thus a fine printing pitch. Each full-step of the stepping motor is broken into 16 micro-steps, and the number of each micro-step is indicated by an encircled numeral in FIG. 10. As explained in the description of the prior art, the position of a rotor 143 of the stepping motor 142 at each micro-step, as indicated by the encircled numerals, directly correlates to a position of the print head 120 at that micro-step. Each micro-stepping of the motor 142 is used to form a pixel at a predetermined position. Hence, 16 pixels are formed between one full-step of the stepping motor 142. It should be clear to one skilled in the art that an optimal spread of pixels across the full-step would be one with equally spaced pixels on the print track 107. That is, on the angular phase diagram of FIG. 10, the desired position of the pixels would be on points with equal angles between adjacent points. This configuration is indicated in FIG. 10 by the points 110. The points 110 each correspond to the position of the rotor 143 of the stepping motor 142 when it causes the print head 120 to align with a desired pixel position. As is clear from FIG. 10, the rotor 143 seldom comes to rest aligned with a desired pixel location. The exceptions are, naturally enough, at the full-step positions and probably the half-step position between them. At all other micro-stepped positions there is often misalignment between the actual angular position of the rotor 143 and the desired angular position of the rotor 143. So there is misalignment between the actual pixel position and the desired pixel position corresponds to that micro-step.

In the first aspect of the present invention, the stepping motor 142 is micro-stepped at regular intervals. Thus, an essentially constant time interval $\Delta I$, shown in FIG. 10, spaces each micro-stepped position, regardless of the relative differences in the angular distributions of the micro-steps. This time, ΔI, offers the rotor 143 time to get to the next micro-stepped position. If, for example, at a time T=0 the motor 142 micro-steps to position 0, then at a time T=ΔI the motor 142 will micro-step from position 0 to position 1. Similarly, at time T=2*ΔI the motor 142 will step from position 1 to position 2, etc.

The stepping motor 142 does not instantaneously reach each succeeding position. At T=0, a first control signal $C_1$ occurs to drive the motor 142 to move from the origin to the position 1. At a time $T=\Delta I+\Delta T_1$ the motor 142 is aligned with the first desired pixel position and the first firing signal $F_1$ occurs to jet the ink, $\Delta T_1$ being the first offset interval. Similarly, at a time T=2*ΔI, a second control signal $C_2$ occurs to drive the motor 142 to move from position 1 to position 2. At a time $T=2*\Delta I+\Delta T_2$ the motor 142 is aligned with a second desired pixel position and the second firing signal $F_2$ occurs to jet the ink, and $\Delta T_2$ is the second offset interval. It is noted that in this example $\Delta T_1$ and $\Delta T_2$ are both negative values. It is the method of the present invention to instruct the print head 120 to jet the ink to form a required pixel when the stepping motor 142 is aligned with a desired pixel position.

In the first embodiment the stepping motor 142 is controlled by a control signal 130*c*, as described in the prior art. The control signal 130*c* is generated by a control circuit 130, which uses the present invention method when printing. Each pulse of this control signal 130*c* causes the stepping motor 142 to advance by one micro-step. The control signals 130*c* are pulsed at essentially equally spaced intervals in this embodiment. The control signals 130*c* sent to the stepping motor 142 to advance the print head 120 along the print track 107 may be labeled $C_1$ to $C_n$. For example, in FIG. 10, 16 control signals 130*c*, respectively labeled $C_1$ to $C_{16}$, are required to perform one full-step. The print head 120 is assumed to form a pixel when it receives a firing signal 130*f*, which was also explained in the description of the prior art. The firing signal 130*f* is also generated by the control circuit 130. These firing signals 130*f* are associated with the control signals 130*c*, and may be similarly labeled $F_1$ to $F_n$. For example, the firing signal $F_2$ is associated with the control signal $C_2$. In FIG. 10, 16 firing signals, $F_1$ to $F_{16}$, can be sent to the print head 120 to form pixels at predetermined positions. These positions are predetermined by the times of their respective firing signals 130*f*. In this embodiment, the relative interval between a control signal $C_n$ and its associated firing signal $F_n$ is determined by a value of $\Delta I+\Delta T_n$. For example, to form a pixel at the first desired pixel location, the firing signal $F_1$ is sent at a time interval of ΔI+ΔT, after the control signal $C_1$. It is at this time that the rotor 143 is aligned with the point 110 that corresponds to the desired pixel location. Similarly, to form a pixel at the second desired pixel location, the firing signal $F_2$ is sent at a time interval of $\Delta I+\Delta T_2$ after the control signal $C_2$. Similarly, to form a pixel at the third desired pixel location, the firing signal $F_3$ is sent at a time interval of $\Delta I+\Delta T_3$ after the control signal $C_3$. In this embodiment, the offset interval $\Delta T_n$ could be a positive value, a negative value, or zero. The offset interval $\Delta T_n$ is decided by experiment and will be stored in a memory for later retrieval. Thus, a list of appropriate offset intervals $\Delta T_n$ is built, with values positive, negative or zero as required, each $\Delta T_n$ corresponding to one desired pixel location. This list of offset intervals adjusts for variations in the stepping motor 142 or in any other part of the driving system 140 that moves the carriage 109. In general, then, for any pixel that is required at desired pixel location "n", a firing signal $F_n$ is sent at a time that is synchronized with the timing of the control signal $C_n$, but which is delayed off of the control signal $C_n$. The amount of this delay is determined by the previously determined offset interval $\Delta T_x$. A pixel should thus be formed that is on, or reasonably close to, the desired pixel location "n". The following table illustrates this, and is in reference to the phase diagram of FIG. 10:

TABLE 1

| Control Signal | Desired Pixel Number | Offset Interval | Firing Signal | Time Interval Between Firing Signal and Control Signal |
|---|---|---|---|---|
| $C_1$ | 1 | $\Delta T_1$ (<0) | $F_1$ | $\Delta I + \Delta T_1$ |
| $C_2$ | 2 | $\Delta T_2$ (<0) | $F_2$ | $\Delta I + \Delta T_2$ |
| . . . | . . . | . . . | . . . | . . . |
| $C_7$ | 7 | $\Delta T_7$ (<0) | $F_7$ | $\Delta I + \Delta T_7$ |
| $C_8$ | 8 | $\Delta T_8$ (=0) | $F_8$ | $\Delta I + \Delta T_8$ |
| $C_9$ | 9 | $\Delta T_9$ (>0) | $F_9$ | $\Delta I + \Delta T_9$ |
| $C_{10}$ | 10 | $\Delta T_{10}$ (>0) | $F_{10}$ | $\Delta I + \Delta T_{10}$ |
| $C_{11}$ | 11 | $\Delta T_{11}$ (>0) | $F_{11}$ | $\Delta I + \Delta T_{11}$ |
| . . . | . . . | . . . | . . . | . . . |
| $C_{16}$ | 16 | $\Delta T_{16}$ (=0) | $F_{16}$ | $\Delta I + \Delta T_{16}$ |

Of note in the above table is the entry for $\Delta T_8$ and for $\Delta T_{16}$. The offset interval $\Delta T_8$ is zero, indicating that in this example the firing signal 130*f* occurs exactly at a delay of ΔI after the control signal 130*c*. The offset interval $\Delta T_{16}$ is zero because at this time the motor 142 has reached a full step and will have no problem firing at the desired pixel position. After $C_{16}$, the pixel numbers return to their initial ordering relative to the control signal 130*c* numbers. It should be further noted here that, due to symmetry, there may be no need to continue a table of offset intervals beyond the number of micro-steps required to complete a full-step. That is, once the end of the offset table is reached, it may be used again from the top as the stepping motor 142 will again be in a rotor 143 positional state that corresponds to the top entry of the table. That is, the rotor 143 will be in a full-step position. It is noted that if the absolute value of offset intervals $\Delta T_1$~ΔT, in table 1 is exactly the same as that of offset intervals $\Delta T_{15}$~$\Delta T_9$ (that is, $\Delta T_1=\Delta T_{15}$; $\Delta T_2=\Delta T_{14}$; . . . ; $\Delta T_7=\Delta T_9$), a table only consisting of offset intervals $\Delta T_1$~$\Delta T_8$ is also sufficient.

Figure 13:
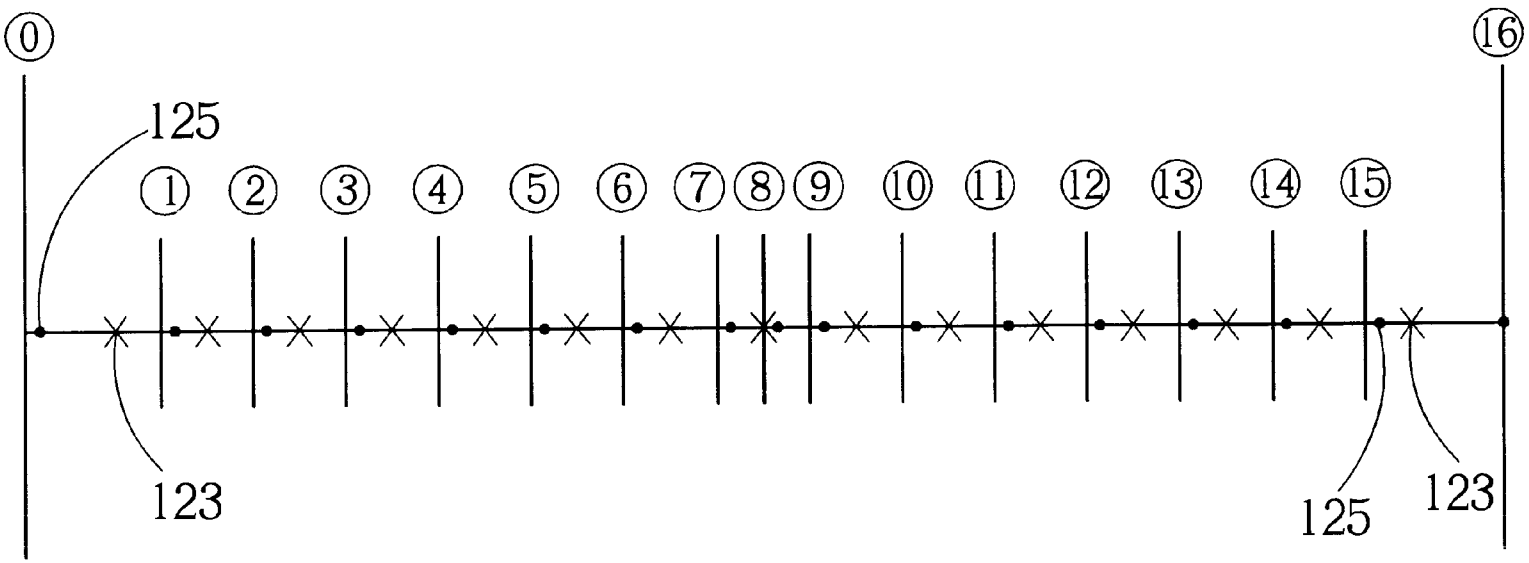
FIG. 13 is a diagram of pixel positions resulting from a constant offset interval printing process for a stepping motor with a phase diagram given as in FIG. 10.

Building a table of offset intervals $\Delta T_n$ is of key importance for the present invention. Simple tinkering, and educational guesses based on trial and error may be used. The following method, however, is one suggestion for obtaining appropriate values for $\Delta T_n$. First, a table of constant offset intervals is supplied to the printer 100 of the present invention. The constant interval value used should be one that ensures that a pixel is formed very shortly after the reception of its associated control signal 130*c*. A printing process is then performed, using this table of constant offset intervals. FIG. 13 is a diagram of pixel positions resulting from such a constant offset interval printing process for the stepping motor 142 with a phase diagram given as in FIG. 10. The stopping position of the rotor 143 for each micro-step is indicated by the lines with encircled numbers. The pixels 125 resultant from this printing process are indicated as solid dots. Each pixel 125 is formed at a predetermined location defined by its corresponding firing signal 130*f* that is delayed off of the corresponding control signal 130*c* by the constant offset interval value. In short, the pattern of pixels 125 directly relates to the angular distribution of the micro-steps shown in FIG. 10. The position of each pixel 125 is then measured against the position of its corresponding desired pixel location 123, which are each indicated by an X. By careful analysis, and knowledge of the rotational speed of the rotor 143, adjustments can be made to each offset interval value in the table to bring the actual printed position of the pixel 125 closer to the desired pixel position 123. With this new table of adjusted offset interval values a new printing process can be performed, and the analysis repeated until all of the actual printed pixel positions 125 land on top of their respective desired pixel locations 123.

Please refer back to FIG. 12. The printer 100 comprises the print head 120, as mentioned above, the driving system 140 for moving the print head 120, and the control circuit 130 for controlling the operations of the printer 100. The print head 120 comprises a plurality of ink orifices 122 that are used to jet ink and form pixels on the document. An ink orifice 122 will form a pixel when it receives the firing signal 130*f* from the control circuit 130. The driving system comprises the stepping motor 142 and a stepping IC 144 for controlling the stepping motor 142, as indicated by arrow 146. Specifically, the stepping IC 144 will trigger a micro-stepping of the stepping motor 142 when the stepping IC 144 receives the control signal 130*c* from the control circuit 130. In this manner, the control circuit 130 can move the print head 120 and cause the ink orifices 122 to form pixels at predetermined pixel locations on the document. The control circuit 130 comprises a timer 132 and a memory 134. The memory comprises a delay interval list 136 and a step counter 138. The step counter 138 is used to remember what micro-step number the stepping motor 142 is at, and is incremented with each control signal 130*c*. When the step counter 138 reaches a value that corresponds to a full-step position, the step counter 138 resets back to zero. The delay interval list 136 is a table of offset intervals, the use of which was previously described. The interval list 136 is indexed via the step counter 138. The timer 132 is used to send control signals 130*c* at equally spaced intervals to the stepping IC 144. In this embodiment the value of the spaced interval is ΔI. The timer 132 is also used to time the offset intervals so as to send firing signals 130*f* at the times required to form pixels on desired pixel locations. The control circuit 130 uses the method disclosed above to adjust for irregularities of the micro-stepping of the stepping motor 142. Following the example of the method disclosed above, Table 2 below shows the corresponding format of the delay interval list 136.

TABLE 2

| Micro-step Counter | ΔT |
|---|---|
| 1 | $\Delta T_1$ |
| 2 | $\Delta T_2$ |
| 3 | $\Delta T_3$ |
| 4 | $\Delta T_4$ |
| 5 | $\Delta T_5$ |
| 6 | $\Delta T_6$ |
| 7 | $\Delta T_7$ |
| 8 | $\Delta T_8$ |
| 9 | $\Delta T_9$ |
| 10 | $\Delta T_{10}$ |
| 11 | $\Delta T_{11}$ |
| 12 | $\Delta T_{12}$ |
| 13 | $\Delta T_{13}$ |
| 14 | $\Delta T_{14}$ |
| 15 | $\Delta T_{15}$ |
| 16 | $\Delta T_{16}$ |

With each micro-step of the stepping motor 142, the control circuit 130 uses the current value of the step counter 138 to index into the delay interval list 136 and obtain an offset interval. If a pixel is required, then the control circuit 130 uses the timer 132 to wait for a period of time corresponding to the offset interval, and then sends a firing signal 130*f* to trigger the orifice 122 to form a pixel at the desired pixel location. Similarly, the control circuit 130 has a look-ahead feature to check for any negative interval offsets following the current interval offset. The step counter 138 is then incremented for the next desired pixel, and the process repeats with the next control signal 130*c*. The delay interval list 136 can be constructed in the manner described previously.

The first embodiment described above uses regularly spaced control signals 130*c* and calibrated interval values in the interval delay list 136 to send calibrated firing signals 130*f* to the print head 120 to form a pixel on a desired pixel location. The second embodiment of this invention operates on very much the same principle as the first, but instead uses regularly spaced firing signals 130*f* and calibrated control signals 130*c* to control the print head 120 so that a pixel is formed on the desired pixel location. The physical arrangement of the printer is the same as that described and indicated in FIG. 9 and FIG. 12, and so those figures may serve in the explanation of the second embodiment. Only the internal operating method is slightly different.

The second embodiment uses the timer 132 to send regularly spaced firing signals 130*f* to the print head 120. The control circuit 130 uses the delay interval list 136 to determine when to send a control signal 130*c* associated with the firing signal 130*f*. Each control signal 130*c* is sent just prior to its associated firing signal 130*f*. The time interval between the control signal 130*c* and the subsequent firing signal 130*f* is determined by an offset interval from the delay interval list 136. The step counter 138 is used to index into the delay interval list 136 and obtain the proper offset interval. As in the first embodiment, the step counter 138 is incremented with each sending of the control signal 130*c* to the stepping IC 144, and is zeroed when the stepping motor 142 reaches a full-step position. As an example, consider the following table of the delay interval list 136 consistent with the on-going example:

TABLE 3

| Micro-step counter | ΔT |
|---|---|
| 1 | $\Delta T_1$ |
| 2 | $\Delta T_2$ |
| 3 | $\Delta T_3$ |
| 4 | $\Delta T_4$ |
| 5 | $\Delta T_5$ |
| 6 | $\Delta T_6$ |
| 7 | $\Delta T_7$ |
| 8 | $\Delta T_6$ |
| 9 | $\Delta T_9$ |
| 10 | $\Delta T_{10}$ |
| 11 | $\Delta T_{11}$ |
| 12 | $\Delta T_{12}$ |
| 13 | $\Delta T_{13}$ |
| 14 | $\Delta T_{14}$ |
| 15 | $\Delta T_{15}$ |
| 16 | $\Delta T_{16}$ |

All of the values for ΔT are either positive or zero. The last pixel, the $16^{th}$, lies on the full-step position of the stepping motor 142, and so, when the stepping motor 142 comes to rest, the print head 120 is perfectly aligned with the $16^{th}$ desired pixel location. It should also be stated here that the offset intervals can specify either a time to send a control signal 130*c* prior to an associated regularly spaced firing signal 130*f*, or they may specify a time to wait after a previous control signal 130*c* before sending the next control signal 130*c*. The two ways of recording the values in the delay interval list 136 are essentially identical, and simply measure from different reference points, i.e., from an impending firing signal 130*f* or from a preceding control signal 130*c*. In either case, the result is the same: a calibrated interval spacing of the control signal 130*c* to ensure that the firing signal 130*f* occurs when the stepping motor 142 is aligned with a desired pixel location.

It should be clear to one skilled in the art that the formation of the delay interval list 136 for the second embodiment would proceed in a similar manner as it does in the first embodiment. That is, initially regularly spaced intervals are used to form an initial delay interval list 136. A test pattern is printed using this initial list 136, and the resultant locations of the pixels are compared to their corresponding desired positions. Each delay interval in the interval list 136 is adjusted for those pixels that are not properly aligned, using known stepping motor 142 timing data and knowledge of the second embodiment of this invention method, to get the pixels to land closer to their desired marks. Using this adjusted list 136, another test pattern is printed and the process is repeated until all of the pixels are printing on their corresponding desired positions.

In contrast to the prior art, the present invention uses a delay interval list to adjust the timing interval between a firing signal and a control signal. This adjusted timing is calibrated to account for stepping irregularities in the stepping motor. Consequently, a firing signal to form a pixel is sent when the position of the stepping motor has the print head aligned with a desired pixel location.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for improving the print quality of a printer, the printer comprising:

a print head for forming a pixel according to a firing signal;

a stepping motor for moving the print head from a first location to a second location, the movement of the print head controlled by a control signal sent to the stepping motor to micro-step the stepping motor; and a timer to provide timing synchronization between the control signals and the firing signals;

the method comprising:

obtaining a delay interval list comprising a plurality of firing offset intervals, each firing offset interval corresponding to a micro-stepping position of the stepping motor;

sending a plurality of control signals so that the print head micro-steps from the first location to the second location; and for each control signal, utilizing the timer to provide a firing signal at a time interval that is spaced from the control signal according to the firing offset interval corresponding to the control signal so that the print head forms a plurality of pixels, each pixel formed on a desired location.

2. The method of claim 1 wherein the delay interval list is formed according to the following steps:

providing an initial firing list of firing offset intervals;

initiating a printing process that uses the initial firing list to form a plurality of pixels at predetermined locations;

comparing the predetermined location of each pixel to the corresponding desired location of the pixel; and adjusting any firing offset interval in the initial firing list to compensate for any pixel whose predetermined location is not sufficiently close to the corresponding desired pixel location, thus forming the delay interval list.

3. The method of claim 1 wherein each firing offset interval indicates an amount of time to wait after the sending of the corresponding control signal before sending the firing signal.

4. The method of claim 3 wherein the control signal is sent to the driving system at effectively regularly spaced time intervals.

5. A method for improving the print quality of a printer, the printer comprising:

a print head for forming a pixel according to a firing signal; and a driving system for moving the print head from a first location to a second location, the driving system comprising a stepping motor, the movement of the print head controlled by a control signal sent to the stepping motor that triggers a micro-stepping function of the stepping motor;

the method comprising:

building a list of desired pixel locations;

building a calibrated list of control signal times corresponding to the desired pixel locations, each of the control signal times adjusted for the corresponding desired pixel location according to the driving system;

generating firing signals, the firing signals being equally spaced with each other; and using the calibrated list of control signal times to send control signals to the stepping motor at predetermined intervals, each of the predetermined intervals insuring that each of the firing signals occurs so that a pixel is formed substantially on a corresponding desired pixel location.

6. The method of claim 5 wherein the list of the desired pixel locations is a list of substantially equally spaced pixels.

7. The method of claim 5 wherein building the calibrated list of control signal times comprises:

providing an initial control signal list of control signal times;

initiating a printing process that uses the initial control signal list to form a plurality of pixels at predetermined locations;

comparing the predetermined location of each pixel to the corresponding desired location of the pixel; and adjusting any control signal time in the initial control signal list to compensate for any pixel whose predetermined location is not sufficiently close to the corresponding desired pixel location, thus forming the calibrated list of control signal times.

8. The method of claim 7 where the initial control signal list is a list of control signal times with equally spaced intervals.

9. The method of claim 5 wherein each of the control signal times indicates an amount of time to wait after a prior control signal is sent before sending a next control signal.

10. A printing system comprising:

a print head for forming a pixel according to a firing signal;

a stepping motor for moving the print head from a first location to a second location, the movement of the print head controlled by a control signal sent to the stepping motor to micro-step the stepping motor;

a timer to provide timing synchronization between the control signals and the firing signals; and a control circuit for generating the firing signal and the control signal, the control circuit comprising a memory that holds a delay interval list that comprises a plurality of offset intervals, each offset interval corresponding to a micro-stepping position of the stepping motor;

wherein for a control signal sent to the stepping motor, the control circuit uses the timer to provide a firing signal at a time interval that is spaced from the control signal according to the offset interval corresponding to the control signal so that the print head forms a pixel on a desired location.

11. The printing system of claim 10 wherein the delay interval list is formed according to the following method:

providing an initial delay list of delay intervals;

initiating a printing process that uses the initial delay list to form a plurality of pixels at locations predetermined by the initial delay list;

comparing the predetermined location of each pixel to a corresponding desired pixel location; and adjusting any delay interval in the initial delay list to compensate for any pixel whose predetermined location is not sufficiently close to the corresponding desired pixel location, thus forming the delay interval list.

12. The printing system of claim 11 wherein the initial delay list is a list corresponding to equally spaced delay intervals for the micro-stepping positions of the stepping motor.

13. The printing system of claim 10 wherein the control circuit sends a plurality of control signals at essentially equally spaced intervals to the stepping motor to micro-step the print head from the first location to the second location, and the control circuit also sends a plurality of firing signals to form a plurality of pixels effectively on corresponding desired pixel locations, wherein each of the desired pixel locations is associated with a control signal from the plurality of control signals, each of the firing signals is associated with a control signal from the plurality of control signals, each of the offset intervals in the delay interval list is associated with a control signal from the plurality of control signals, and the firing signal time of a firing signal is determined by the time of the associated control signal and the associated delay interval.

14. The method of claim 13 wherein each of the offset intervals indicates an amount of time to wait after the sending of the control signal associated with the offset interval before sending a firing signal to form a pixel at the associated desired pixel location.

15. The printing system of claim 10 wherein the control circuit sends a plurality of control signals to the stepping motor to micro-step the print head from the first location to the second location, and the control circuit also sends a plurality of firing signals to form a plurality of pixels effectively on corresponding desired pixel locations, the firing signals being sent at essentially equally spaced intervals; wherein each of the desired pixel locations is associated with a control signal from the plurality of control signals, each of the offset intervals in the delay interval list is associated with a control signal from the plurality of control signals, and the control signal time of a control signal is determined by the time of a prior control signal and the associated offset interval.

* * * * *